US005680714A

United States Patent [19]

Lopez

[11] Patent Number: 5,680,714

[45] Date of Patent: Oct. 28, 1997

[54] TRAMPOLINE EFFECT ATHLETIC SHOE HAVING ELASTIC SOLE RETURN STRIPS

[76] Inventor: Randy Gerald Lopez, 5902 S. Fiesta Ave., Tucson, Ariz. 85706

[21] Appl. No.: 677,560

[22] Filed: Jul. 8, 1996

[51] Int. Cl.[6] ..... A43B 13/18

[52] U.S. Cl. ..... 36/27; 36/28; 36/35 R; 36/37

[58] Field of Search ..... 36/27, 28, 35 R, 36/37, 38

[56] References Cited

U.S. PATENT DOCUMENTS

| | | | |
|---|---|---|---|
| 1,132,132 | 3/1915 | Tysse | 36/28 |
| 4,598,487 | 7/1986 | Mosevich | 36/114 |
| 4,638,577 | 1/1987 | Riggs | 36/28 X |
| 5,005,299 | 4/1991 | Whatley | 36/27 X |
| 5,070,629 | 12/1991 | Grahmam et al. | 36/28 X |

FOREIGN PATENT DOCUMENTS

| | | | |
|---|---|---|---|
| 72963 | 7/1916 | Australia . | |
| 672650 | 2/1939 | Germany . | |
| 2243530 | 11/1991 | United Kingdom | 36/27 |

*Primary Examiner*—Ted Kavanaugh
*Attorney, Agent, or Firm*—John P. Halvonik

[57] ABSTRACT

An athletic shoe having a resilient return portion comprising a plurality of elastic strips running at an angle across the shoe from one side of the sole to the opposite side of the shoe. Such strips would be supported at a distance above the bottom surface of the shoe by a gap or well located in the shoe and running from the bottom surface of the shoe to the upper surface where the bottom of the foot rests. There may be provided a series of apertures extending through the thickness of the bottom of the shoe in order to relieve air pressure that may build up between the sole and the return portion.

5 Claims, 4 Drawing Sheets

TRAMPOLINE EFFECT ATHLETIC SHOE HAVING ELASTIC SOLE RETURN STRIPS

BACKGROUND OF THE INVENTION

1. Field of the Invention

The invention relates to the field of athletic shoes and, in particular, to an athletic shoe having a return portion that provides a series of resilient strips located at diagonal angles across the width of the shoe. The return portion of the shoe will be made of a material that will stretch from it's normal length under the pressure of the user's foot and return to its normal length as the user's foot moves upward. The resilient portion will provide a bounce back effect on the user's feet during walking and or running.

It is believed that use of such a plurality of elastic strips will produce a trampoline like effect on the user's feet as the material returns to its natural length as the user's foot return upward. The effect on the user's feet is thought to be somewhat akin to that of a trampoline. Such effect is thought to be beneficial to the user as the effect may be felt by the user and the springing action may have some effect on the bottoms of the feet. The return action of the elastic strips is though to provide beneficial effect on the bottoms of the feet by stimulating the feet and/or cushioning them from shock as each foot hits the running surface at the bottom of the stride.

2. Prior Art

While there are shoes that provide for resilient portions above the sole, none of them are known to be constructed of a series of elastic strips running laterally and at an angle across the width of the shoe. Moreover, none of the prior art is believed to provide a trampoline like effect on the user's feet during running and/or walking.

SUMMARY OF THE INVENTION

An athletic shoe having a resilient return portion located in a gap or well that extends from the bottom surface of the shoe to that surface that contacts the bottom of the foot. The return portion of the shoe is designed to provide an effect on the user's feet some what akin to that of a trampoline during the upward component of the user's step. The return portion should comprise a plurality of elastic strips running at an angle across the shoe from one side of the shoe to the opposite side of the shoe. Such strips would be supported at a distance above the bottom surface of the shoe by by being connected to the walls of the gap. The use of the gap allows the return portion to depress downward into the well upon the impact of the foot and the running surface. The resilient return portion will then bounce back into the original position across the top of the well during the upward movement of the foot.

Such strips should be overlapping one another in order that their effect can be felt along the entire length of the foot and so that the shoe can be manufactured with an inexpensive process that may wrap the elastic around the sole of the shoe as part of one operation. There may be two such wells, one in the sole and one in the heel portion of the shoe. There may be provided a series of apertures extending through the bottom wall of the shoe in order to relieve air pressure that may build up between the sole and the energy return portion. Air may be exhausted through these apertures.

It is among the objects of the invention to provide an athletic shoe that will stimulate the user's feet and lessen the impact of the action of the feet upon the ground or other running surface by cushioning such action through the use of elastic straps Another objective is to provide an athletic shoe having a return portion that can be manufactured easily and inexpensively and made of elastic material.

Another objective is to provide an athletic shoe that allows the user of the shoe to have greater agility due to the bounce back nature of the return energy portion of the shoe.

Another objective is to provide an athletic shoe that is of lightweight construction and having an energy return portion in the shoe.

Another object is to provide an athletic shoe having a return portion between the sole and the upper and that will minimize wear on the sole and upper parts of the shoe.

Other objectives of the invention will be readily apparent to those skilled in the art once the invention has been described.

DESCRIPTION OF THE PREFERRED EMBODIMENT

Figure 5:
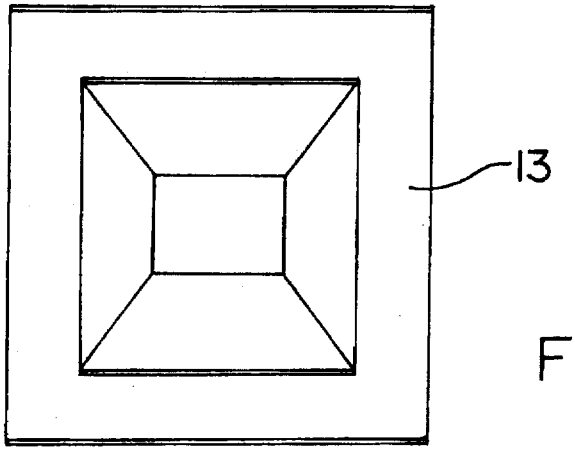
FIG. 5 Top view looking down on the optional well with tapered walls.

The energy return straps in the shoe may be made of any state of the art materials suitable for such. Such materials include: elastic, rubber and/or synthetic materials such as thermoplastics. The outside or peripheral portion 13 of the shoe should be of greater thickness than the inner part of the sole, this outside portion may be referred to as the "built up portion". A well is constructed as a hollowed out portion 1 located between the bottom surface 3 of the shoe and that surface 5 (top of the sole) that contacts the bottom of the foot. See FIGS. 2, 5 and 6.

This well does not extend all the way through the shoe there being a relatively thick wall 7 between the gap and the bottom surface 3 of the shoe. The undersurface 3 is a portion of wall 7. The wall 7 may be somewhat less thick than wall 13 but it should be thick and strong enough so that it can support the foot and will not bow under when put under stress. The well may be of any state of the art material. There may be apertures 15 in this thick wall in order to expel air in the well, see FIG. 3.

Figure 2:
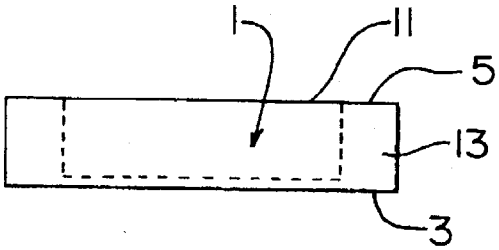
FIG. 2 Side view of well with straight sides.
Figure 9:
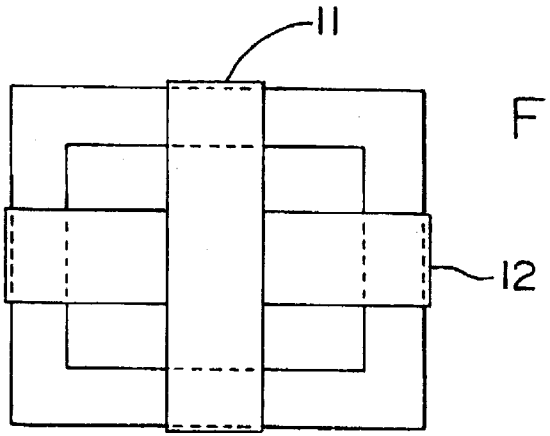
FIG. 9 Top view of insert with straps attached.
Figure 1:
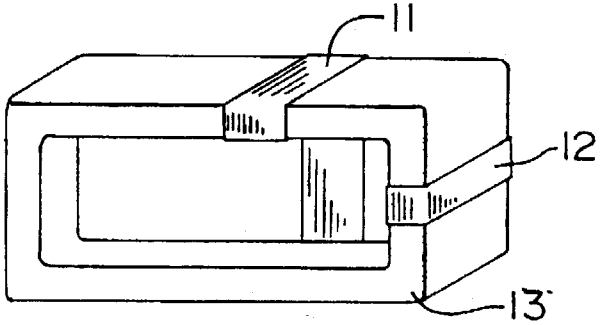
FIG. 1 Underside of shoe showing connection of resilient straps to the sides and bottom of the shoe.
Figure 8:
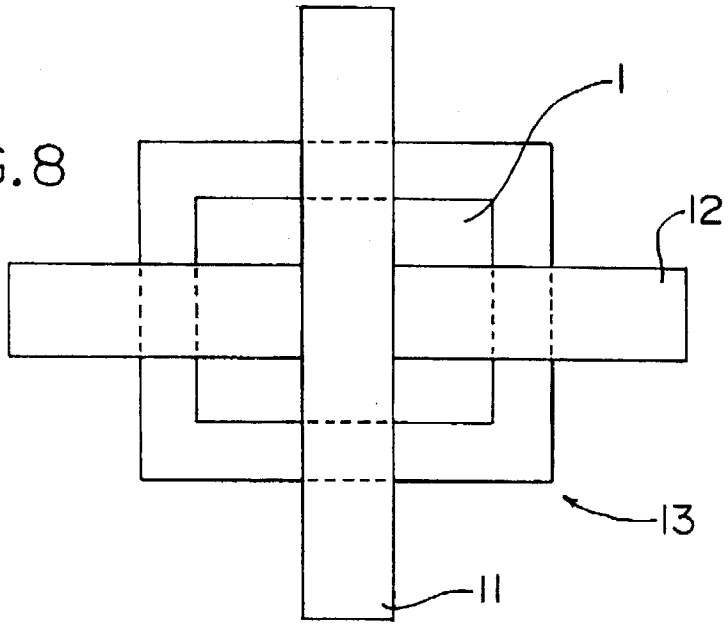
FIG. 8 Top view of insert showing method of attaching straps.
Figure 6:
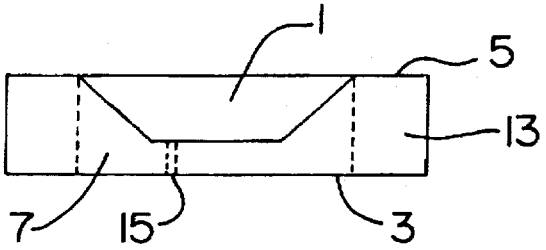
FIG. 6 Side view of well showing tapered walls.

This outer portion 13 will define the outer wall of the well and will support the return portions 11, made up of resilient straps 11 and 12, at a distance above the bottom surface 3 of the shoe as seen in FIGS. 2 and 6.

Thus there will be a hollow area (also known as the "gap" or the "well") in each area of the shoe where the resilient straps are located. It is preferred that there be two wells, one in connection with the area of the heel that contacts the heel of the foot and one in that area of the sole that contacts the ball of the foot, see FIG. 3. The portion 17 of the shoe between the heel and the sole should be of ordinary construction in order to support the instep.

The walls of the well should taper inward so that the well is narrower at the bottom (near the bottom of the sole) as opposed to the top, near where the foot is, see FIG. 6. This tapering should be used when the highly stretchable version of the resilient straps are used (see discussion below). This tapering will create then another wall 25 at the bottom of the well that will protect the bottom of the foot should it "bottom out" i.e. should the pressure of the foot overcome the resiliency of all the straps, the sole of the foot would then be in danger of contacting the bottom of the shoe. The tapering wall adds an additional safeguard to protect the foot.

The dimensions of the well are likely to be about 1.5" width and about 3" in length as measured from the inner diameter. The depth of the well would similar to that of the thickness of a typical running shoe. Of course, these distances may vary in the same manner that the sizes of shoes may vary greatly. It is thought that the elastic strips may vary in width from about ¼" to about one inch, this size may vary, of course. The length may be determined as needed. The resilient strip may be as thin as 10 millimeters depending on the relative strength of the material chosen as the resilient material.

The return portion of the shoe should be made of resilient strips of material 11 that will extend in length when they are acted upon. In this case, as the user's foot impacts the running surface the resilient strips will stretch and extend downward into the well 1. As the user's foot moves upward these strips will return back to their normal, pre-stressed, length and will return back to position stretched over the gap. The return strips may be attached to the shoe in different ways including stapling, gluing, riveting, sewing, and other methods. They may be of various lengths in order to incorporate them into the shoe. The angle of the strips with the midline of the shoe may be varied. The resilient strips may be made of materials that are strong enough to support the user and his foot but flexible enough to stretch e.g. a rubber band.

Optionally, a harder, less resilient strap may be used in place of the resilient straps. It is believed that the following somewhat materials would work well as materials for the straps: HYTREL, a polyester elastomer made by DuPont Corp. or Wilmington, Del.; PREVAIL, a thermoplastic made by Dow Plastics; and PELLETHANE also made by Dow Plastics which is a polyurethane elastomer. Also SANTOPERENE is a rubber product also made by Advanced Elastomer Systems and can range from being flexible to very hard. Other materials may find use as material for the straps.

The shoe may be further divided into two parts-the sole will correspond to the ball of the foot and the heel will correspond to the heel of the foot and there may be a well in each part. The area 17 between these parts may be raised up at the same height as the periphery of the sole and thus be used in the same manner as the peripheral portion. In other words, to support the resilient return strips above the bottom surface of the shoe. In this case, there will be one set of strips going across the well in the sole and another series of strips going across the well in the heel.

Figure 4:
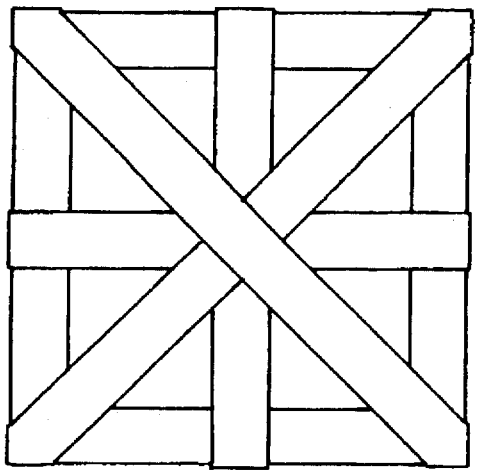
FIG. 4 Arrangement of resilient of straps at angle to the midline of the shoe.

The return portion of the shoe will comprise a plurality of elastic strips that are stretched across the sole from one side of the shoe to the other as shown in FIG. 4. The strips should overlap one another and run at a angle that is diagonal with the midline line of the shoe or the sole as shown in FIG. 4. The exact angle of the strips to the midline may vary by trial and error. The bottom of the strips may be attached to the sides and bottom of well as shown in FIG. 2.

Figure 7:
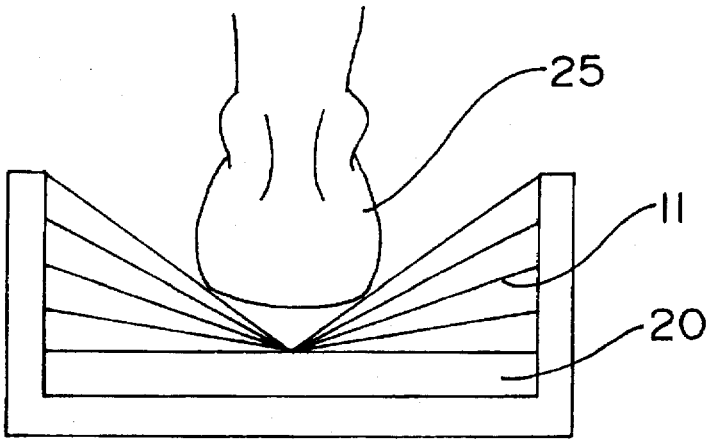
FIG. 7 Optional arrangement showing gaps between straps.
Figure 10:
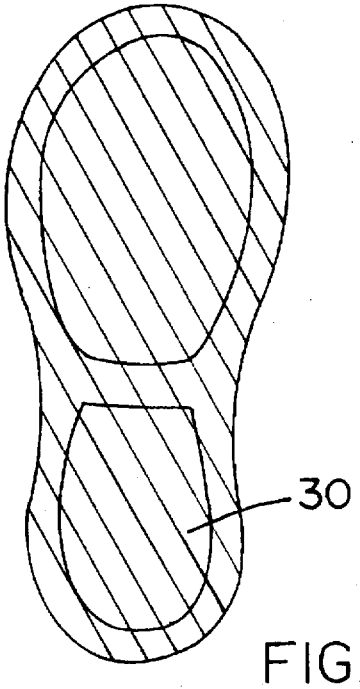
FIG. 10 Top view of optional model with one piece elastic material.

Each of the elastic straps may be separated from one another by gaps 20 as shown in FIG. 7. A heavier person, and/or someone who is running will compress the layers to a greater degree than someone who is walking or lighter in weight. The layers will thus compress to a greater or lesser degree as by the impact of the foot 25. For example, a light person may only depress the first two layers while a heavier person will compress say three or four layers. Of course the exact number may vary.

It is thought that the use of such strips will make for an easier manufacturing process than constructing the return portion in a different fashion. By attaching such strips at an angle to the sole it may be easier to construct such shoes by simply wrapping the elastic as one long strips across the width of the sole. By overlapping each strip of elastic with the previous one, the shoe may be constructed by a manufacturing process that would produce a series of straps that cross over one another; i.e. each pair of strips cross over one another.

Figure 12:
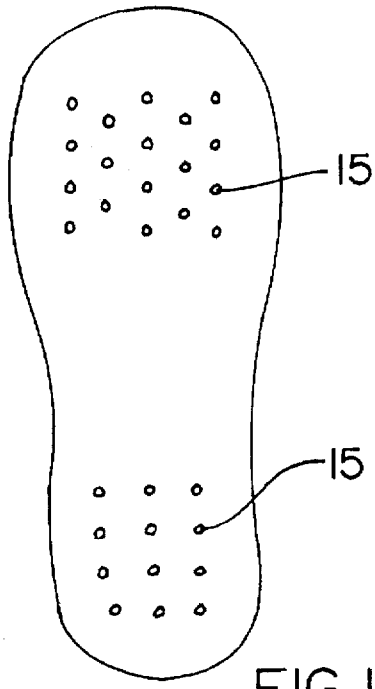
FIG. 12 Bottom view of optional model.
Figure 11:
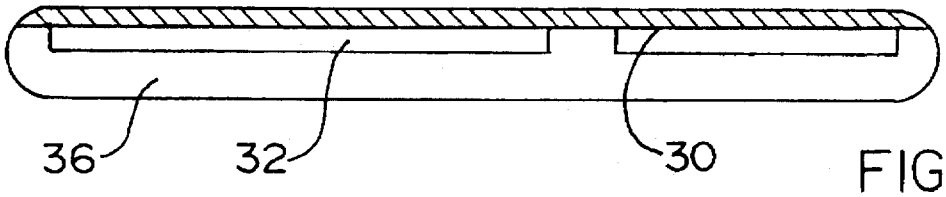
FIG. 11 Side view of optional model.
Figure 13:
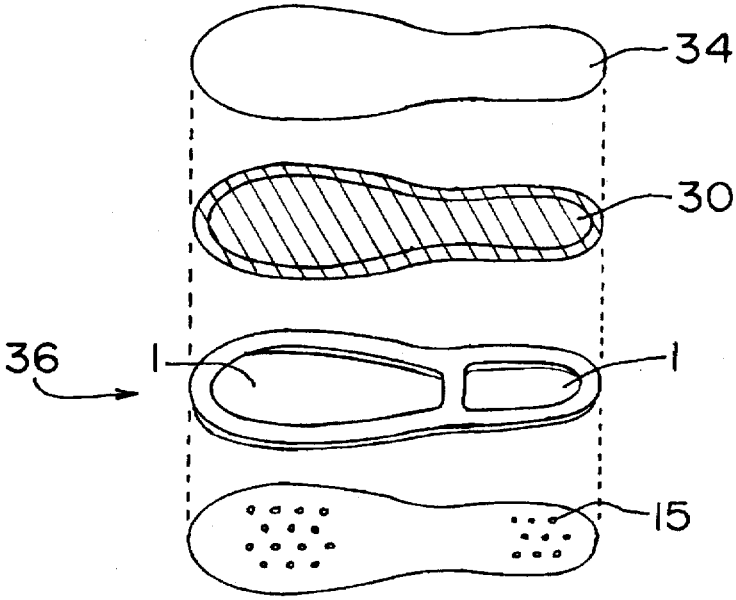
FIG. 13 Blow apart view of pieces in optional model.

An alternative arrangement to the elastic strips is shown in FIGS. 10–13. A one piece elastic material 30 may be used above the sole. This creates a gap 32 between the bottom of the shoe 36 and the flexible portion 30 as seen in FIG. 11. FIG. 12 shows the bottom of the show which will also use the holes 15 that are used in the other models. FIG. 13 shows the different parts in a blow apart view. The use of the intermediate portion 36 has cutout portions in order to create a well 1 near both the heel and the ball of the foot. 34 may be a piece of foamed material that is softer than 30 and will be in direct contact with the bottom of the foot. This one piece material may be made of the same materials or similar to those materials described above for the strips.

Figure 3:
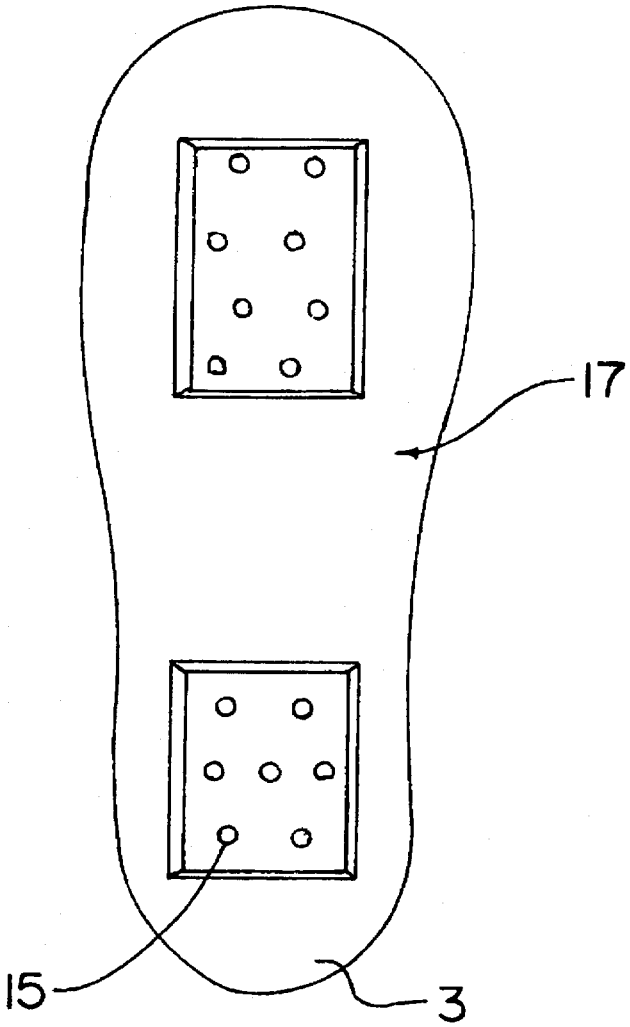
FIG. 3 Bottom view of shoe showing optional apertures.

The bottom surface 3 of the shoe may have a plurality of smaller holes 15 in the bottom and extending the entire thickness of the sole, see FIGS. 3, 6 and 12. Such holes may vary in number. Such holes are suitable for allowing air to exit from the well between bottom wall and the return portion. It thought that during the lower portion of the user's step, the air in the well will be compressed by the action of the foot on the return portion.

During use, the return portion will extend into the well upon the impact of the foot with the running surface, see FIG. 7. Such action will compress the air in this gap at that time and the use of holes will provide exit passage for the air. Without the air holes 15 to relieve this compression of the air, such impact of the foot with the running surface may be likely to cause wear to the outer or to the sole.

The upper portion of the shoe may be composed of state of the art materials. (Upper not shown). Such an upper may be chosen from those materials such as leather, cloth or polymerics and should connect to the sole of the shoe. The upper will hold the user's foot in the shoe.

It is believed that the use of elastic material as the preferred material of the strips would be beneficial to the user as such a shoe would have longer lasting properties and provide for a more natural return of the elastic as it springs up during the upward element of the user's step.

I claim:

1. An improved athletic shoe having a sole and an athletic upper in connection with said sole, said sole having a peripheral portion having a top surface and a bottom surface, said sole having an inner portion within an area defined by said peripheral portion, said peripheral portion having an aperture extending through said sole, said sole having a plurality of elastic material strips stretching across said aperture and in connection with said top surface of said peripheral portion, said strips aligned in at least two directions so that a portion of said plurality of strips are aligned at an angle to another portion of said plurality of strips, said strips overlapping one another so that elastic material completely overlies said aperture; said resilient strips being about ¼" to about 1" in width, a bottom portion in connection with said bottom surface of said peripheral portion.

2. The apparatus of claim 1 wherein said angle is about 90°.

3. The apparatus of claim 2 wherein said sole has a first and a second aperture, said first aperture corresponding to the ball of the foot and said second aperture corresponding to the heel of the foot.

4. The apparatus of claim 2 where said plurality of strips comprises 2–10 resilient strips.

5. The apparatus of claim 2 wherein said elastic material is chosen from the group comprising; nylon, rubber, thermoplastics, polyester and polyurethane elastomers.

* * * * *